US005402861A

United States Patent [19]

Kohara

[11] Patent Number: 5,402,861

[45] Date of Patent: Apr. 4, 1995

[54] ELEVATOR PASSENGER CAR AND DEVICE FOR EVALUATING FEEL OF RIDE IN ELEVATOR

[75] Inventor: Hideya Kohara, Tokyo, Japan

[73] Assignee: Kabushiki Kaisha Toshiba, Kawasaki, Japan

[21] Appl. No.: 136,130

[22] Filed: Oct. 15, 1993

[30] Foreign Application Priority Data

Oct. 15, 1992 [JP] Japan ..... 4-277308
Mar. 9, 1993 [JP] Japan ..... 5-048379

[51] Int. Cl.[6] ..... B66B 9/00
[52] U.S. Cl. ..... 187/292; 187/391
[58] Field of Search ..... 187/1 R, 17, 105, 106, 187/107, 115, 131, 100

[56] References Cited

U.S. PATENT DOCUMENTS 4,995,478 2/1991 Oshima et al. ..... 187/115
5,308,938 5/1994 Roberts et al. ..... 187/115

FOREIGN PATENT DOCUMENTS 0350582 1/1990 European Pat. Off. .
0336883 5/1990 European Pat. Off. .
1407158 9/1975 United Kingdom .
2205921 12/1988 United Kingdom .

*Primary Examiner*—Kenneth W. Noland
*Attorney, Agent, or Firm*—Oblon, Spivak, McClelland, Maier & Neustadt

[57] ABSTRACT

An elevator passenger car including a car frame, a cage mounted to the car frame and an anti-vibration tuber member positioned between a bottom face of the cage and a lower portion of the car frame for supporting the cage. The elevator passenger car further includes a load sensing unit for measuring a passenger loading of the passenger car and a control device connected to receive the passenger loading for comparing the passenger loading with a passenger car resonance loading range to generate a control signal based on a comparison result. The elevator passenger car also includes an adjustment device positioned between the bottom face of the cage and the lower portion of the car frame for receiving the control signal from the control device and for adjusting a natural frequency of the passenger car based on the control signal by co-operating with the anti-vibration rubber member. Resonance of the passenger car with an externally applied frequency force is then avoided. A device for evaluating the feel of the ride in an elevator is further disclosed.

14 Claims, 11 Drawing Sheets

FIG. 10(a)
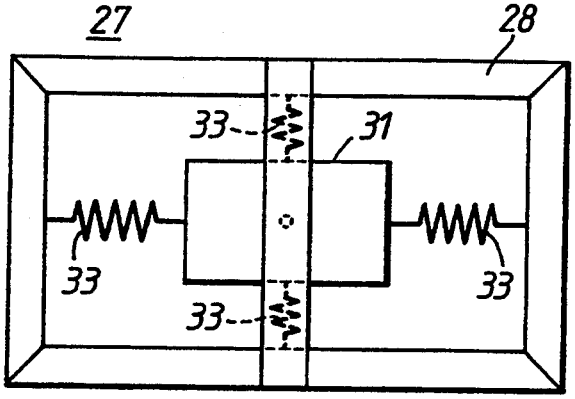
FIG. 10(b)
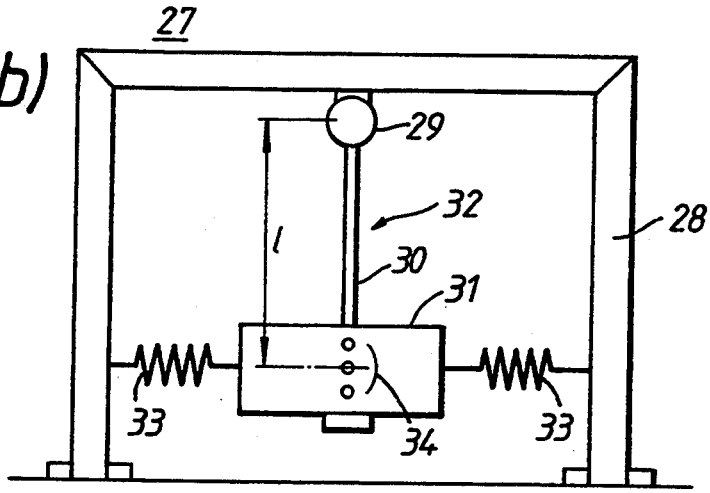
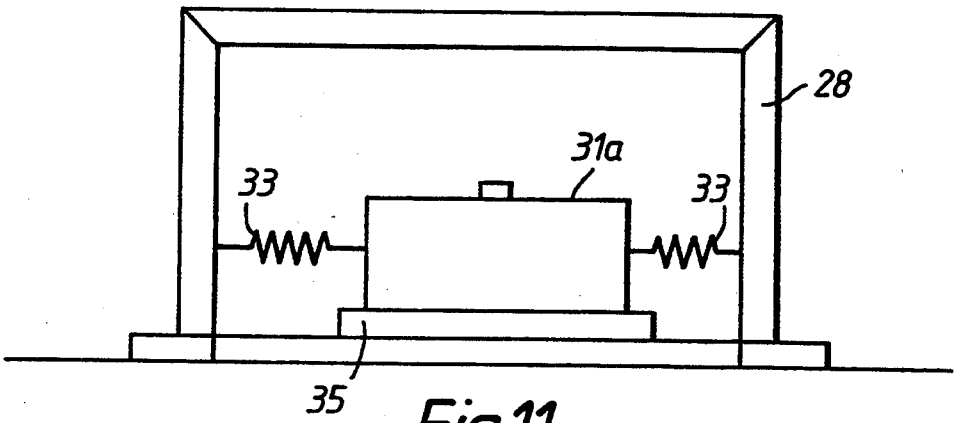
Fig.11

ELEVATOR PASSENGER CAR AND DEVICE FOR EVALUATING FEEL OF RIDE IN ELEVATOR

BACKGROUND OF THE INVENTION

1. Field of the Invention

This invention relates to an elevator that is raised and lowered along guide rails provided on a hoistway of a multi-storey building. In particular, it relates to an elevator passenger car in which the feel of the ride in the elevator is improved.

This invention further relates to a device for evaluating the feel of the ride in an elevator.

2. Description of the Related Art

FIG. 14 shows the-construction of a prior art elevator passenger car of this type. Specifically, guide rails 2 are each erected vertically on both side walls of a hoistway 1 of a multistorey building, and a passenger car 4 is provided that is free to be raised and lowered between these two guide rails 2, by means of a main rope 3.

This passenger car 4 is constructed of a car frame 5 and a cage 6 mounted therein and equipped with a door, door opening/closing mechanism, illumination device, and in-cage operating panel etc. not shown, Furthermore, above and below car frame 5 there are mounted a total of four guide devices 7. These guide devices 7 are each provided with guide rollers 7*a* that are in rolling contact with the two side faces and end face of one of two guide rails 2. Displacement of guide roller 7*a* is adjusted by means of an elastic body 7*b*.

Further, respective floor-support frames 8 are provided extending below car frame 5. Respective anti-vibration rubber elements 9 are arranged in four locations so as to support cage 6, between these floor supporting frames 8 and the bottom face of cage 6.

Additionally, a load sensing unit 10 that measures the load carried by passenger car 4 is arranged between floor support frames 8 and cage 6.

However, during ascent and descent, due to bending of guide rails 2, bending produced by installation errors etc in installing guide rails 2, and steps etc at joints of guide rails 2, vibration is transmitted from guide rails 2 to passenger car 4. This vibration is transmitted to the passengers in passenger car 4, making the elevator ride less comfortable.

Conventionally therefore it was sought to improve the feel of the elevator ride by absorbing the vibration by anti-vibration rubber elements 9 and/or elastic body 7*b*.

However, with the construction described above, it is not possible to completely remove the vibration from guide rails 2. Furthermore, depending on the running speed, it can happen that the frequency of applied vibration (1.4 Hz to 2.7 Hz) due to forcible displacement such as bending of guide rails 2 may coincide with the first order natural frequency (1.5 Hz to 4 Hz) of elevator passenger car 4, resulting in resonance, which produces very large transverse swaying of passenger car 4. This greatly lowers the comfort of the ride in passenger car 4.

Furthermore, even if the first order natural frequency of passenger car 4 is set in the design stage so as not to coincide with applied vibration frequencies from guide rail 2, it is possible for the first order natural frequency of passenger car 4 to change with change in the-loading of passenger car 4, resulting in resonance occurring.

For example, the first order natural frequency of a passenger car of an elevator in which the weight of the passenger car itself is 2500 kg and which is to carry 1600 kg changes, depending on changes (0–1600 kg) in the passenger live load, in the range 1.9 Hz to 3.1 Hz.

Next, the method of evaluating the feel of the ride in an elevator will be described. A conventional method of measuring vibration for evaluation of the feel of the ride in an elevator, and a device therefor, will be described with reference to FIG. 15.

In FIG. 15, passenger car 4 is constituted by car frame 5 and cage 6 carried thereon.

The method of measuring the vibration for evaluating the feel of the ride in passenger car 4 was first of all to detect the vibration in each direction of the floor surface of cage 6 by means of an accelerometer 24 mounted on the floor of cage 6, these measurements being converted to voltage. These voltage signals were then amplified using an amplifier 25, and the vibration was measured by inputting these vibration waveform data into a data recorder 26.

In this way, the feel of the ride in passenger car 4 was evaluated by measuring the vibration acceleration of the floor surface of cage 6 of passenger car 4.

However, with the above construction, the vibration of the floor surface of passenger car 4 is measured, so the feeling actually experienced by a person cannot be determined. It is therefore difficult to evaluate the actual feel of the elevator ride.

Furthermore, in evaluating the feel of the ride, the evaluation of the feel of the ride must be made by analysis or data processing using the vibration data of the passenger car floor surface, so the person making the evaluation needs to have experience, knowledge and technical skill and furthermore some time is required to perform the evaluation. It is therefore difficult to evaluate the feel of the elevator ride immediately on site.

SUMMARY OF THE INVENTION

Accordingly, one object of this invention is to provide an elevator passenger car wherein the occurrence of resonance due to externally applied vibration is avoided, making the elevator ride more comfortable.

Another object of this invention is to provide an elevator passenger car which can improve the actual feel of the elevator ride.

Another object of this invention is to provide a device for evaluating the feel of the ride in an elevator which can detect the vibration experienced by a person rapidly and accurately and can evaluate the feel of the elevator ride based on the detected vibration.

These and other objects of this invention can be achieved by providing an elevator passenger car including a car frame, a cage mounted to the car frame and an anti-vibration rubber member positioned between a bottom face of the cage and a lower portion of the car frame for supporting the cage. The elevator passenger car further includes a load sensing unit for measuring a passenger loading of the passenger car and a control device connected to receive the passenger loading for comparing the passenger loading with a passenger car resonance loading range to generate a control signal based on a comparison result. The elevator passenger car also includes an adjustment device positioned between the bottom face of the cage and the lower portion of the car frame for receiving the control signal from the control device and for adjusting a natural frequency of the passenger car based on the control signal by co-operating with the anti-vibration rubber member.

Resonance of the passenger car with an externally applied frequency force is then avoided.

According to one aspect of this invention there is provided a device for evaluating the feel of the ride in an elevator including a vibration device adapted to be positioned on a floor surface of a passenger car of the elevator. The vibration device includes a frame, a pendulum having an arm and a weight element member attached to the arm, the pendulum being suspended from a ceiling of the frame, and an elastic member first end of which being mounted to a side wall of the frame. The weight element member is supported by the elastic member at second end thereof in the horizontal direction. The weight element member vibrates by means of a vibration of the passenger car. The device further includes a detector for detecting an acceleration of the vibration of the weight element member, whereby the feel of the ride in the elevator is evaluated based on the acceleration.

According to another aspect of this invention there is provided a device for evaluating the feel of the ride in an elevator including a vibration device adapted to be positioned on a floor surface of a passenger car of the elevator. The vibration device includes a frame, a linear guide provided on the frame, a weight element member positioned on the linear guide, and an elastic member, first end of which being mounted to a side wall of the frame. The weight element member is supported by the elastic member at second end thereof in the horizontal direction, and the weight element member vibrates by means of a vibration of the passenger car. The device further includes a detector for detecting an acceleration of the vibration of the weight element member, whereby the feel of the ride in the elevator is evaluated based on the acceleration.

According to still another aspect of this invention there is provided an elevator passenger car including a car frame, a cage mounted to the car frame, an anti-vibration rubber member positioned between a bottom face of the cage and a lower portion of the car frame for supporting the cage. The passenger car further includes a device positioned on a floor surface of the passenger car for evaluating the feel of the ride in the elevator. The device includes a vibration device positioned on a floor surface of the passenger car of the elevator and a detector. The vibration device includes a frame, a pendulum having an arm and a weight element member attached to the arm, the pendulum being suspended from a ceiling of the frame, and elastic member first end of which being mounted to a side wall of the frame. The weight element member is supported by the elastic member at second end thereof in the horizontal direction. The weight element member vibrates by means of a vibration of the passenger car. The detector detects an acceleration of the vibration of the weight element member. The elevator passenger car further includes a control device connected to receive the acceleration for comparing a value of the acceleration with a reference value to generate a control signal based on a comparison result. The reference value corresponds to a vibration acceleration value at which the passenger feels uncomfortable. The elevator passenger car further includes an adjustment device positioned between the bottom face of the cage and the lower portion of the car frame for receiving the control signal from the control device and for adjusting a natural frequency of the passenger car based on the control signal by co-operating with the anti-vibration rubber member. Whereby the feel of the ride actually experienced by the passenger is improved.

The frequency of applied vibration generated by bending of the guide rails or steps etc at joints of the guide rails when the passenger car ascends or descends is found beforehand by calculation. And only in the passenger car resonance loading region in which resonance due to coincidence of this frequency with the first order natural frequency of the passenger car is anticipated, the adjustment device is made to co-operate with the anti-vibration rubber element. As a result the spring constant in the lateral direction of the passenger car is adjusted, thereby lowering or raising the first order natural frequency of the passenger car. Resonance can therefore by avoided.

By this arrangement, the feel of the ride in the elevator that is experienced by a person is evaluated by measuring the vibration acceleration of the weight element simulating a person. That is, by making the characteristic vibrational frequency of this weight element coincide with 4 to 8 Hz (the natural frequency of the human body), at which human beings are liable to feel discomfort, it is possible to determine with how much vibrational acceleration the weight of the human body model sways when this vibrational frequency is applied.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 10 is a view showing the evaluation device shown in FIG. 9, where (a) is a cross-sectional view thereof and (b) is a front view thereof;

FIG. 11 is a front cross-sectional view of an evaluation device according to another embodiment of this invention:

DETAILED DESCRIPTION OF THE PREFERRED EMBODIMENTS

Figure 1:
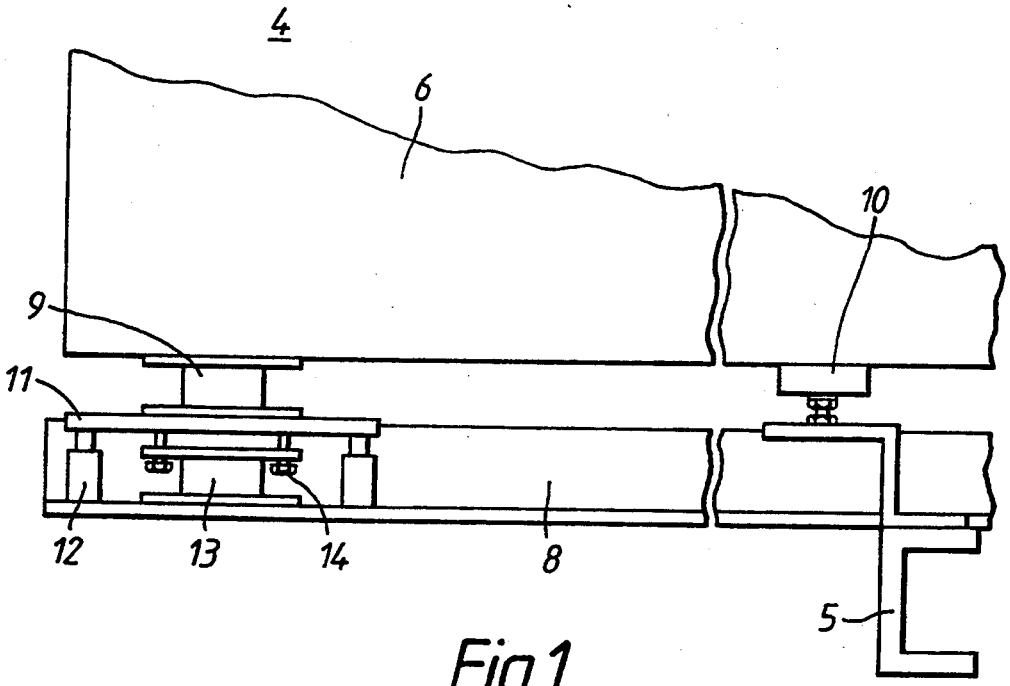
FIG. 1 is a front view showing major parts of an elevator passenger car according to an embodiment of this invention.

Referring now to the drawings, wherein like reference numerals designate identical or corresponding parts throughout the several views, the embodiments of this invention will be described below. FIG. 1 is a front view showing major parts of an embodiment of this invention.

As shown in FIG. 1, below the floor of cage 6, anti-vibration rubber elements 9 as ordinarily employed are mounted on a floor-carrying frame 8 through an anti-vibration tuber element base 11 and an actuator 12 such as fop example a hydraulic cylinder. Also, below anti-vibration rubber element base 11, an adjustment anti-vibration rubber element 13 that is made to act when the passenger car is in a resonance loading range is mounted on floor-carrying frame 8 through anti-vibration rubber element guide 14. Specifically, the top portion of adjustment anti-vibration rubber element 13 is engaged with the bottom portion of anti-vibration rubber element base 11 through anti-vibration rubber element guide 14.

Figure 2:
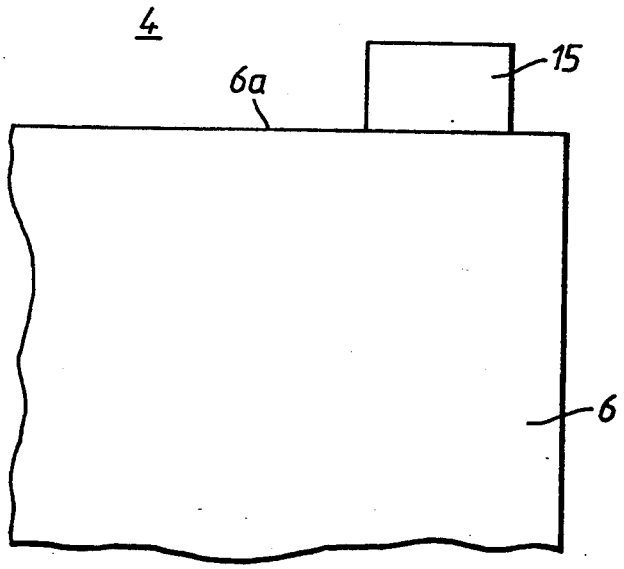
FIG. 2 is a front view showing another major parts of the elevator passenger car shown in FIG. 1.

Furthermore, as shown in FIG. 2, a control device 15 for actuating actuator 12 in response to the detected value of load sensor 10 is mounted above ceiling 6*a* of cage 6. This control device 15 includes a known hydraulic power unit which is provided with a pump and is connected through a hose with actuator 12, control device 15 is also connected through a cable (not shown) to an elevator control device (not shown) arranged in a machinery chamber (not shown) above the hoistway 1.

Figure 3:
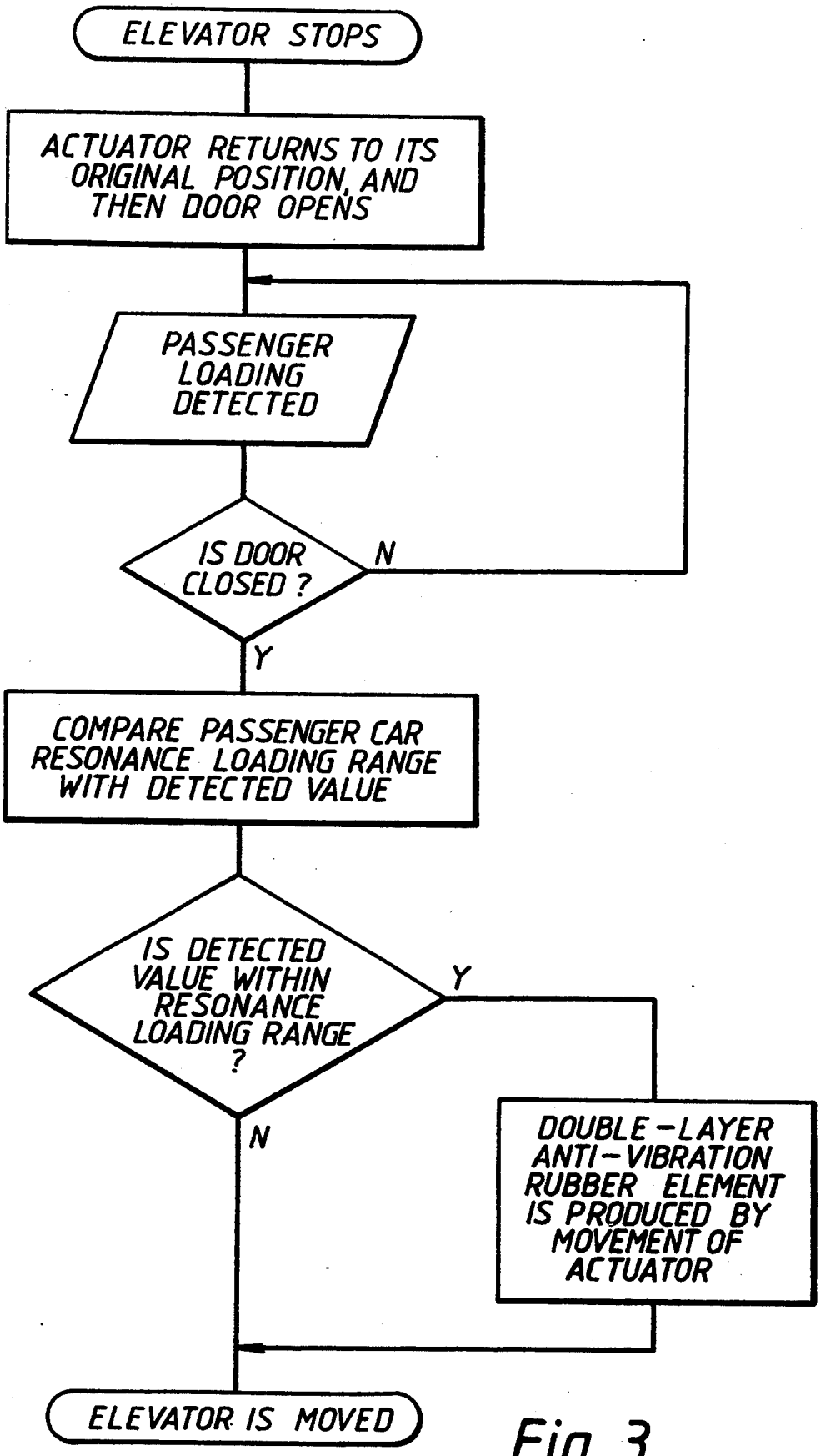
FIG. 3 is a flow chart showing the operation of the embodiment of this invention shown in FIGS. 1 and 2.
Figure 4:
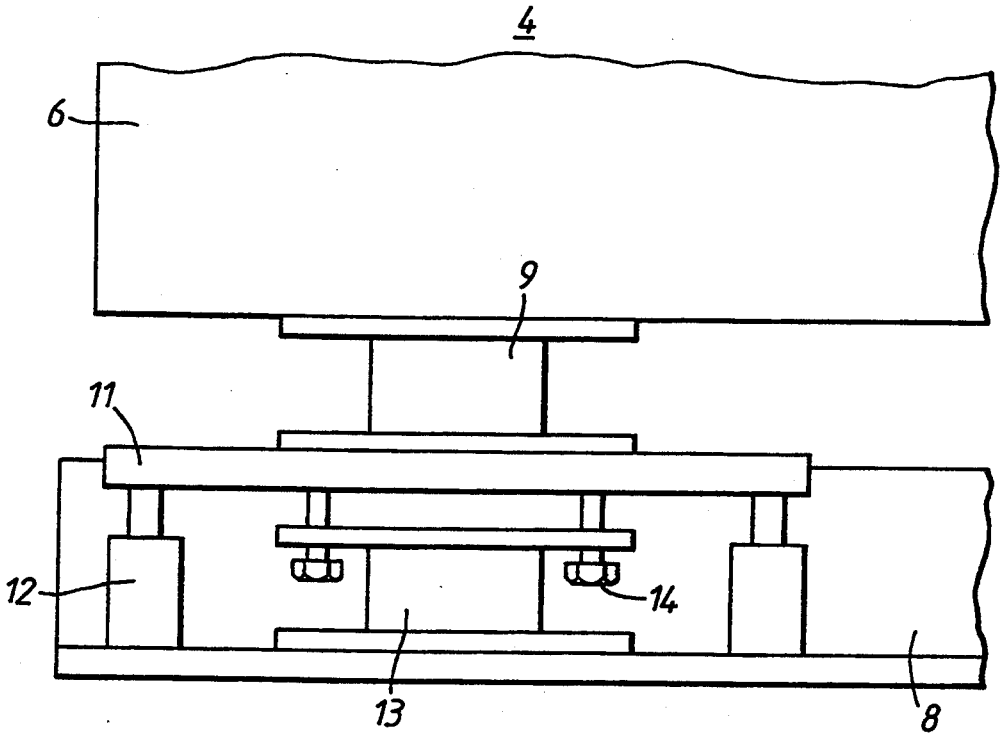
FIGS. 4 and 5 are front views showing lower major parts of the passenger car according to the embodiment of this invention.

Next, the action of the embodiment constructed as above will be described with reference to FIG. 3. Actuator 12 is returned to its starting point by a signal from control device 15 when the elevator stops at a floor in response to a call from a passenger. In other words, the relationship between anti-vibration rubber element 9 and adjustment anti-vibration rubber element 13 is disengaged. FIG. 4 shows the lower part of passenger car 4 in this condition. After this, the door, not shown, of cage 6 is opened by means of a door opening/closing mechanism.

Figure 5:
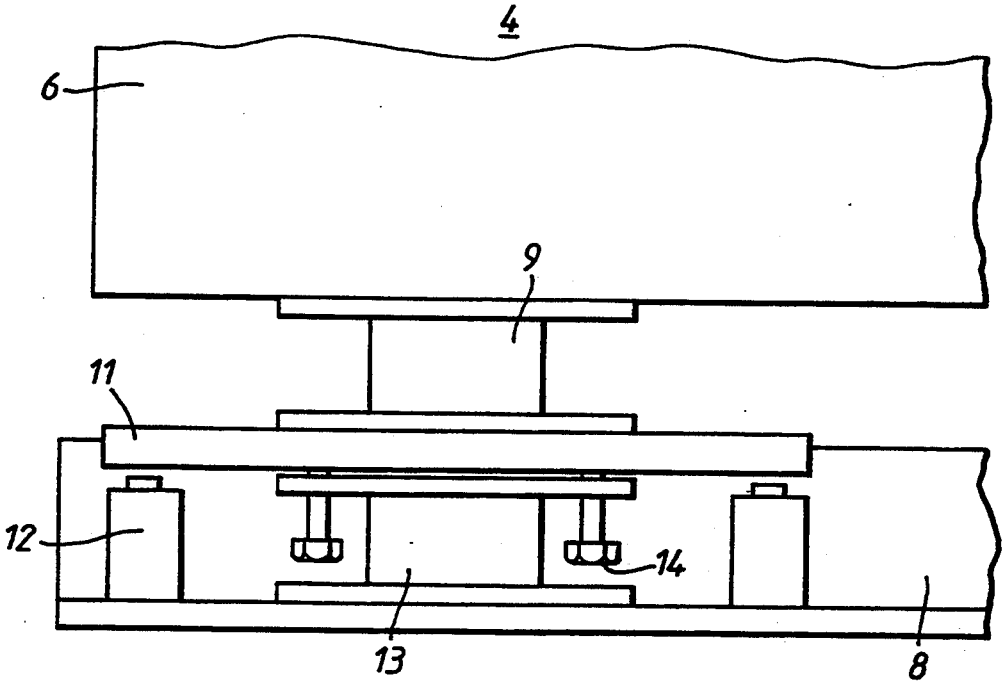

When the passenger loading changes, this loading is detected by load sensor 10. Anti-vibration rubber element base 11 is then lowered by actuation of actuator 12 in response to a signal from control device 15 when passenger car 4 has a loading within the passenger car resonance loading range in which it resonates with applied vibration from guide rails 2. Where, the passenger car resonance loading range has been obtained by previous calculation and experiment, the details of which are described belows. A condition is thereby produced in which anti-vibration rubber element 9 is directly stacked on adjustment anti-vibration rubber element 13 i.e. a stacked condition of anti-vibration rubber element 9 and adjustment anti-vibration rubber element 13. FIG. 5 shows the lower part of passenger car 4 in this condition. Thus, cage 6 is at a condition in which it is supported on floor support frame 8 through two anti-vibration rubber element systems stacked one upon another. The elevator is then moved.

Figure 6:
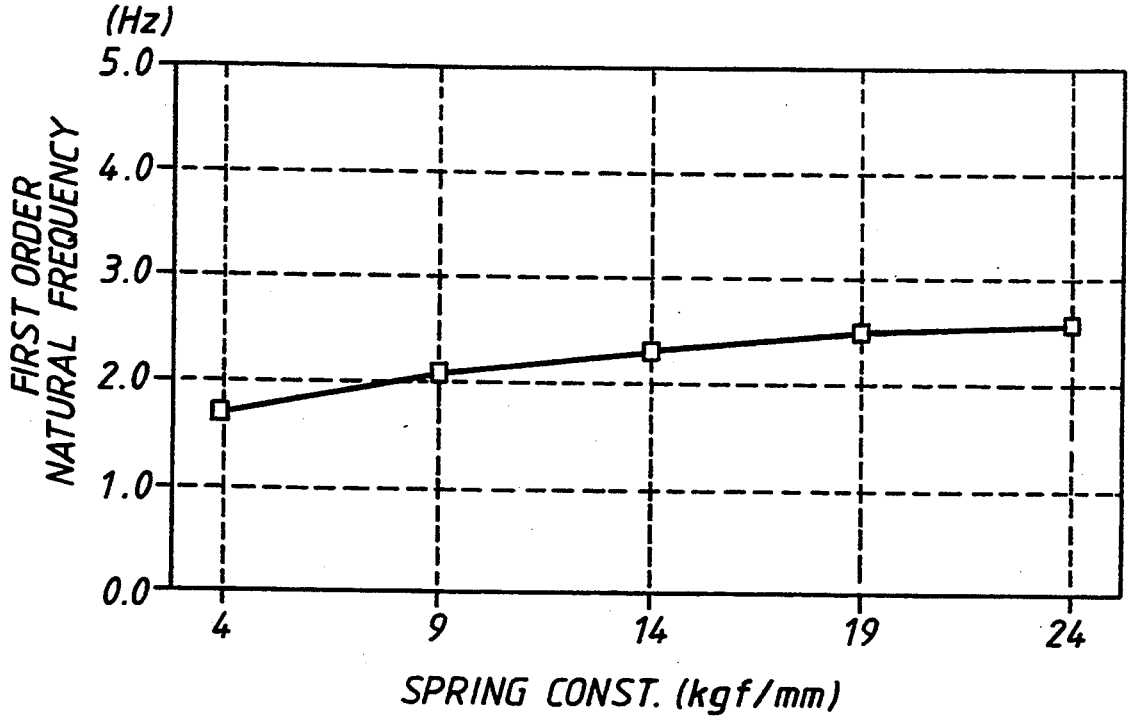
FIG. 6 is a curve showing the relationship between the spring constant of the anti-vibration rubber element and its natural frequency involved in the embodiment of this invention.

As is well known, the spring constant in the shearing direction of the rubber of an anti-vibration rubber element or the like decreases as the height of the rubber element is increased or as more rubber elements are stacked. The spring constant in the shearing direction of the two anti-vibration rubber elements stacked one upon another i.e. the spring constant in the transverse direction of passenger car 4 is therefore lowered. FIG. 6 shows the relationship between the spring constant of the anti-vibration rubber element of the passenger car and its natural frequency. As shown in FIG. 6 lowering the spring constant lowers the first order natural frequency of passenger car 4. Resonance of passenger car 4 can thereby be avoided.

Figure 7:
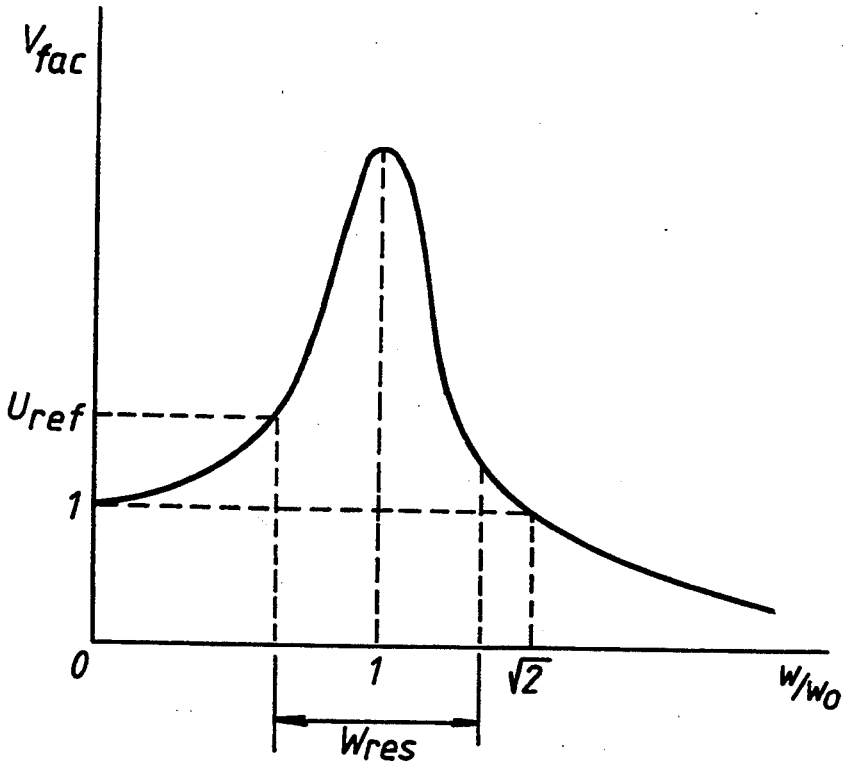
FIG. 7 is a curve showing the vibration response factor involved in the embodiment of this invention.

Hereinafter, the details of obtaining the passenger car resonance loading range will be described. FIG. 7 shows the relationship between the frequencies and the vibration response factor Vfac. In FIG. 7, w is the applied vibration frequency of the guide rails 2, and w0 is the natural frequency of the passenger car 4. An upper limit reference Uref for the vibration response factor Vfac is previously given. The passenger car resonance loading range Wres for the ratio w/w0 is determined such that the vibration response factor Vfac is below the upper limit reference Uref.

Figure 8:
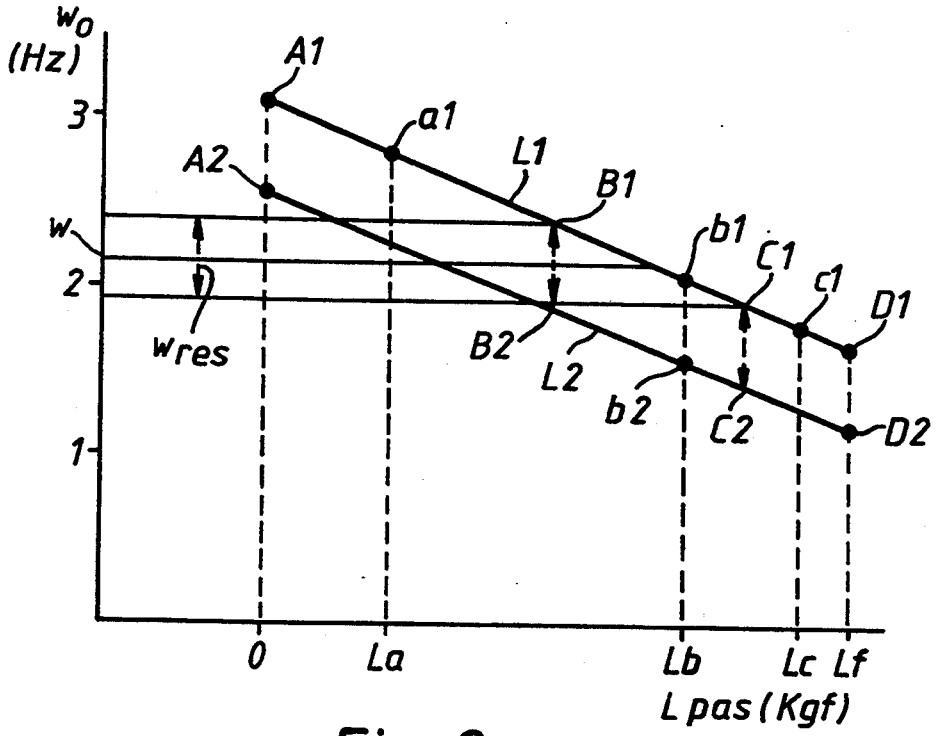
FIG. 8 is a diagram showing the change in the natural frequency of the passenger car in the embodiment of this invention.

FIG. 8 shows the relationship between the passenger loading Lpas and the natural frequency w0 of the passenger car 4. The actual passenger car resonance loading range wres is determined by dividing the actual applied vibration frequency w of the guide rails 2 which has been previously measured by the passenger car resonance loading range Wres obtained as described above. The upper sloping straight line L1 shows the first case where only anti-vibration rubber element 9 is used. The lower sloping straight line L2 shows the second case where anti-vibration rubber element 9 and adjustment anti-vibration rubber element 13 are stacked in a double layer configuration. When the passenger loading Lpas changes from zero to the full load Lf, the natural frequency w0 changes from A1 to D1 through B1 and C1 along the line L1 in the first case, and from A2 to D2 through B2 and C2 along the line L2 in the second case.

Next, the details of the adjustment of this embodiment will be described with reference to FIG. 8. In a case where the passenger loading Lpas is La or Lc, the natural frequency w0 is at a point a1 or c1 on the line L1, which is not included in the passenger car resonance loading range wres, so that only anti-vibration rubber element 9 is used. In a case where the passenger loading Lpas is Lb, the natural frequency w0 is at a point b1 on the line L1, which is included in the passenger car resonance loading range wres, so that adjustment anti-vibration rubber element 13 is then stacked in a double layer configuration. Then the natural frequency w0 is at a point b2 on the line L2, which is not included in the passenger car resonance loading range wres. Resonance can therefore be avoided. The actual adjustment is carried out under the control of the control device 15 as shown in FIG. 3.

Consequently, with the embodiment constructed as above, when change in the passenger loading of the passenger car causes the passenger loading to get within the resonant loading range of the passenger car, a condition is produced in which the anti-vibration rubber elements and adjustment anti-vibration rubber elements are stacked in two layers one upon another, thereby lowering the first order natural frequency of the passenger car. Resonance of the passenger cap is thereby avoided and the vibration response factor Vfac can be kept below the upper limit reference Uref, and the acceleration of the passenger car can also be kept below a certain standard. Of the transverse vibrations of the passenger car, passenger car vibrations due to passenger car resonance can therefore be greatly reduced, enabling the comfort of the ride in the elevator to be improved.

Furthermore, since the construction is in the form of an addition to the conventional system, and the weight of the addition is very small, the existing passenger car can be employed.

This invention is not limited to this embodiment. In the embodiment, when the passenger loading Lpas is within the passenger car resonance loading range wres, adjustment anti-vibration rubber element 13 is stacked in a two layer configuration. But, according to another embodiment, the two layer configuration is basically used. When the passenger loading Lpas is within the passenger car resonance loading range wres, adjustment anti-vibration rubber element 13 is disengaged with anti-vibration rubber element 9, and only anti-vibration rubber element 9 is used, thereby raising the first order natural frequency of the passenger car. In this embodiment, resonance of the passenger car is also avoided.

Figure 9:
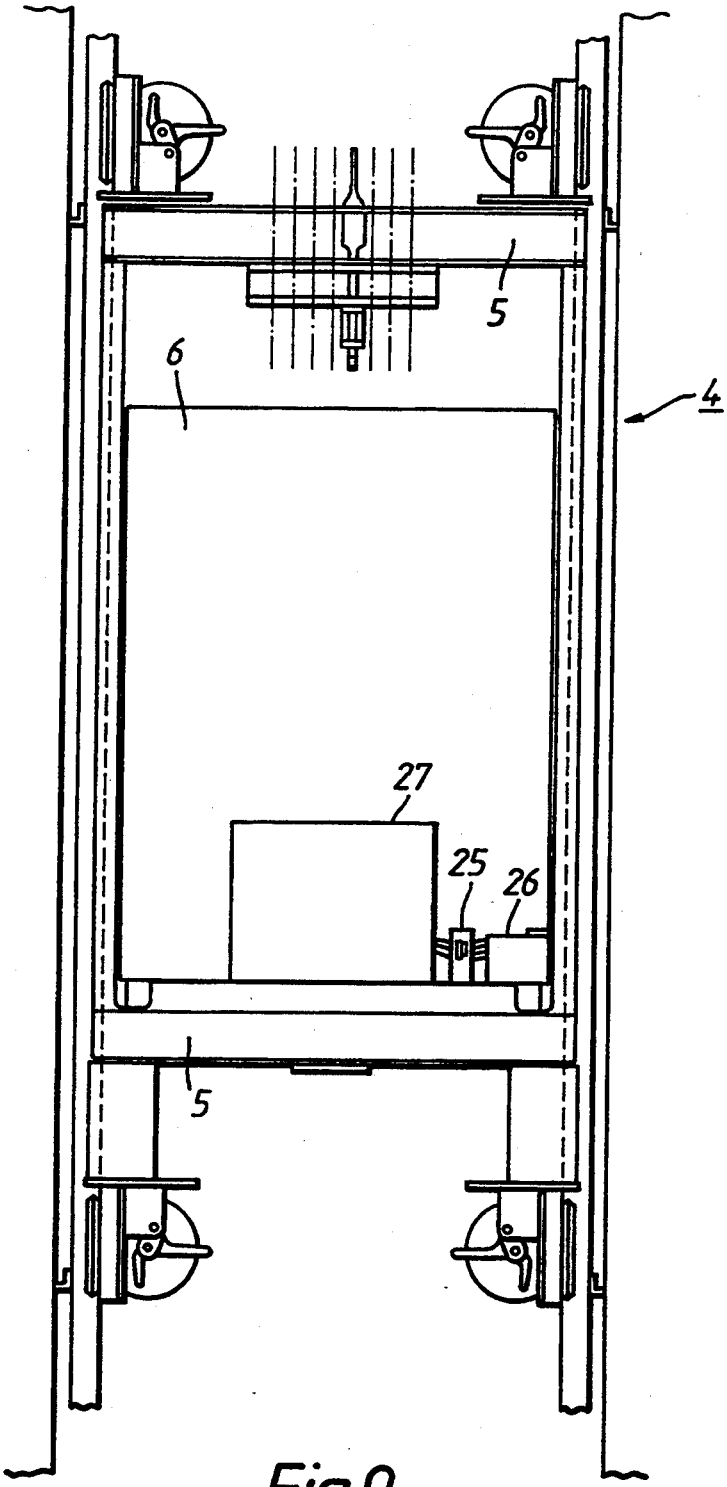
FIG. 9 is a front cross-sectional view of an elevator passenger car provided an evaluation device according to another embodiment of this invention.

Next, a device for evaluating the feel of the ride in an elevator according to another embodiment of this invention will be described with reference to FIG. 9 and FIG. 10.

In an elevator ride evaluation device 27 a measurement box is constructed by sticking plates around a rigid frame 28. An arm 30 of a pendulum 32 is mounted on the ceiling of this box by means of a universal joint 29. The pendulum 32 is constituted by mounting a weight element 31 at the tip of arm 30. The length l of the pendulum 32 can be altered by altering the position of mounting weight element 31 using a plurality of mounting holes 34 provided in arm 30. This weight element 31 is supported by springs 33 from left and right an from front and rear.

The feeling of the elevator ride produced by the vibration acceleration of passenger car 4 is determined by arranging the measurement device box constituted as above on the floor surface of cage 6 as device 27 for evaluating the feel of the elevator ride. An accelerometer (not shown) is provided to detect an acceleration of the vibration of weight element 31.

A human body is simulated by weight element 31 by making the natural frequency f of the transverse swaying vibration mode of weight element 31 coincide with a natural frequency of the human body, for example 4–8 Hz, by adjusting a length l of pendulum 32 (distance between the fulcrum of arm 30 and the center of gravity of weight element 31) and the spring constant K of springs 33 of this device 27, if the value of weight element 31 that models the human body is made equal to the body weight of a human being, for example 65 kgf.

In this case, the natural frequency f of the transverse swaying vibration mode of weight element 31 of this device 27 is given by:

$$f=[1/(2\pi)]\times[(2K/M)+(G/l)]^{\frac{1}{2}}(\text{Hz})$$

Where K is the spring constant of the springs 33 (the elastic bodies) (kgf/mm), M is the mass of the weight element 31 (kg)

G is the acceleration due to gravity (mm/sec$^2$)

l is the length of the pendulum 32 (distance between the fulcrum of arm 30 and the center of gravity of the weight element 31, mm).

Thus, the vibration acceleration experienced by a person can be determined by determining the vibration acceleration of the weight element 31 of this human body model.

If the simulation is effected by matching the weight element 31 to the body weight of a person, if this device 27 is unmodified, some operational difficulty may be caused by its weight and size. In such cases, the human body is modeled to a reduced scale, for example a weight value of weight element 31 is set to one half to one tenth of that of a reference body weight of a human body. Then the vibration acceleration experienced by a human being can be determined by modifying the vibrational acceleration of the weight element of this model with the values obtained by a correspondence rule or a relational experiment when the value of the weight of the weight element is 65 kgf.

By means of the evaluation device constructed as above, the vibration acceleration can be measured at the frequency to which people are sensitive (i.e. the frequency at which the body resonates due to coincidence with the natural frequency of the human body). Furthermore, the vibration acceleration experienced by a human body which is produced by the swaying of the cage floor can be determined by measuring the transverse swaying vibration acceleration of the weight element that models the human body, and not just by measuring the vibration of the cage floor.

The feeling of the elevator ride can thereby be properly evaluated. Accordingly, in the evaluation of the feel of the ride, the data analysis or data processing is not necessary. Also, in the case of adjustment or trouble-shooting at a site, the evaluation can be made without measuring a vibration acceleration with an accelerometer at the site. Namely, the change in the feeling of the ride in the elevator depending on the position in which the passengers stand in the elevator can easily be determined by setting up the measurement box in any desired position on the floor surface.

The feel of the elevator ride can be rapidly and accurately evaluated by means of the data obtained by the determinations. Hence, evaluation can be performed by detecting the frequency of vibration by altering the natural frequency of this device, or the vibration level can be studied to some extent simply by visually observing the swaying of the weight element.

FIG. 11 shows another embodiment of this invention. In FIG. 11, a weight element **31*a* is carried on a linear guide 35, weight element 31 being supported by means of springs 33. The vibration experienced by the human body can thus be determined by adjusting the natural frequency of the left and right parallel advance mode of weight element 31*a* by changing the spring constants of springs 33**.

The natural frequency f in the transverse swaying vibration mode of weight element **31*a*** in this case is given by:

$$f=(\tfrac{1}{2}\pi)\times(2K/M)\ (\text{Hz})$$

Where K is the spring constant of the springs 33, the elastic bodies, (kgf/mm) and M is the mass of weight element **31*a*** (kg).

The elevator passenger cap and the device for evaluating the feel of the ride in an elevator, both as described above, can be combined with, so that the feel of the ride in an elevator will be mope improved. Such an embodiment of this invention will be described below.

Figure 12:
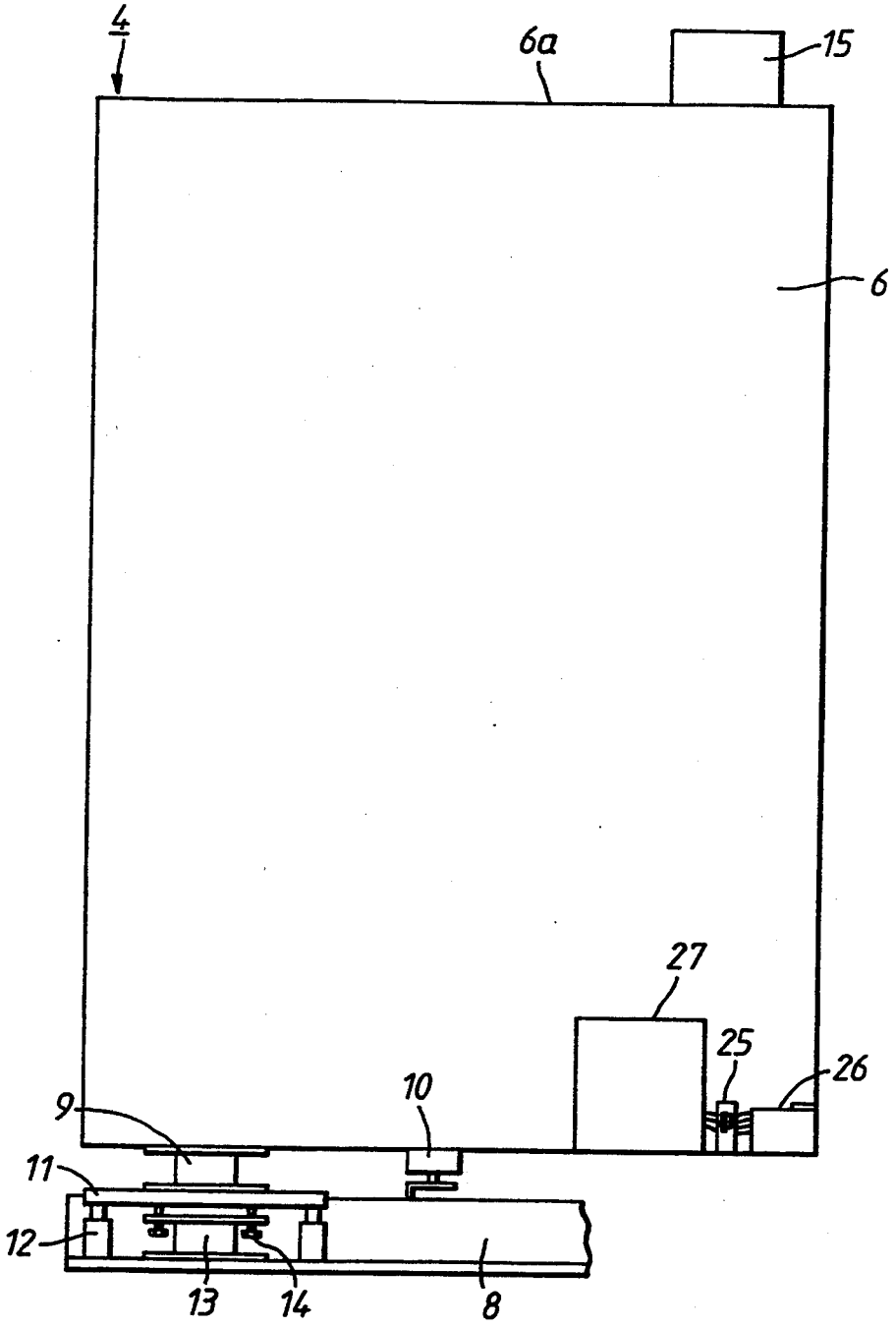
FIG. 12 is a front view showing major parts of an elevator passenger car according to still another embodiment of this invention.

FIG. 12 shows an elevator passenger cap according to another embodiment of this invention. In FIG. 12, anti-vibration rubber element 9, load sensor 10, anti-vibration rubber element base 11, actuator 12, adjustment anti-vibration rubber element 13 and anti-vibration rubber element guide 14 are provided under cage 6 as in FIG. 1. Control device 15 is also mounted above ceiling 6a of cage 6. There ape also provided evaluation device 27, amplifier 25 and data recorder 26 on the floor sufrace of cage 6 as in FIG. 9.

Figure 13:
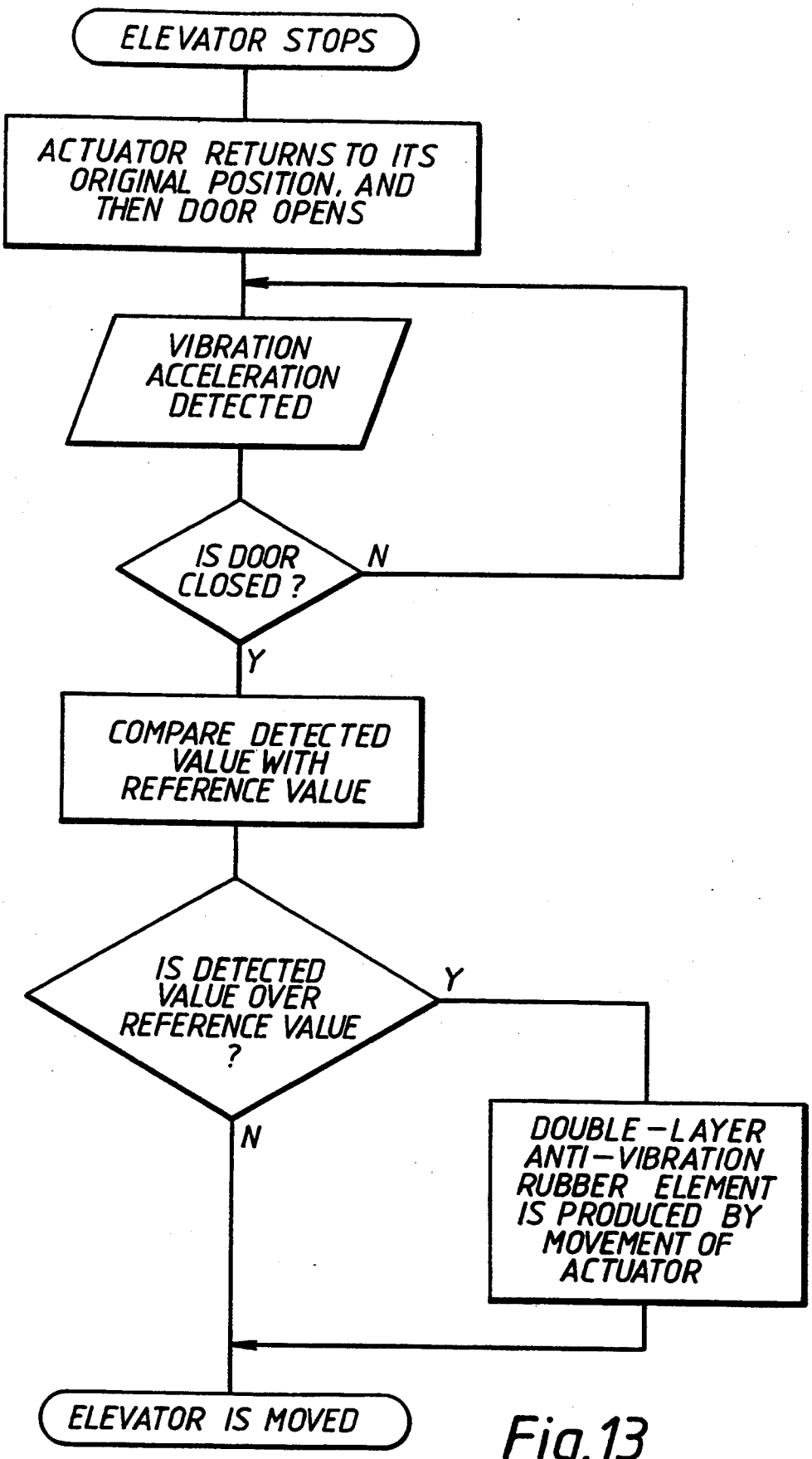
FIG. 13 is a flow chart showing the operation of the embodiment of this invention shown in FIG. 12.
Figure 14:
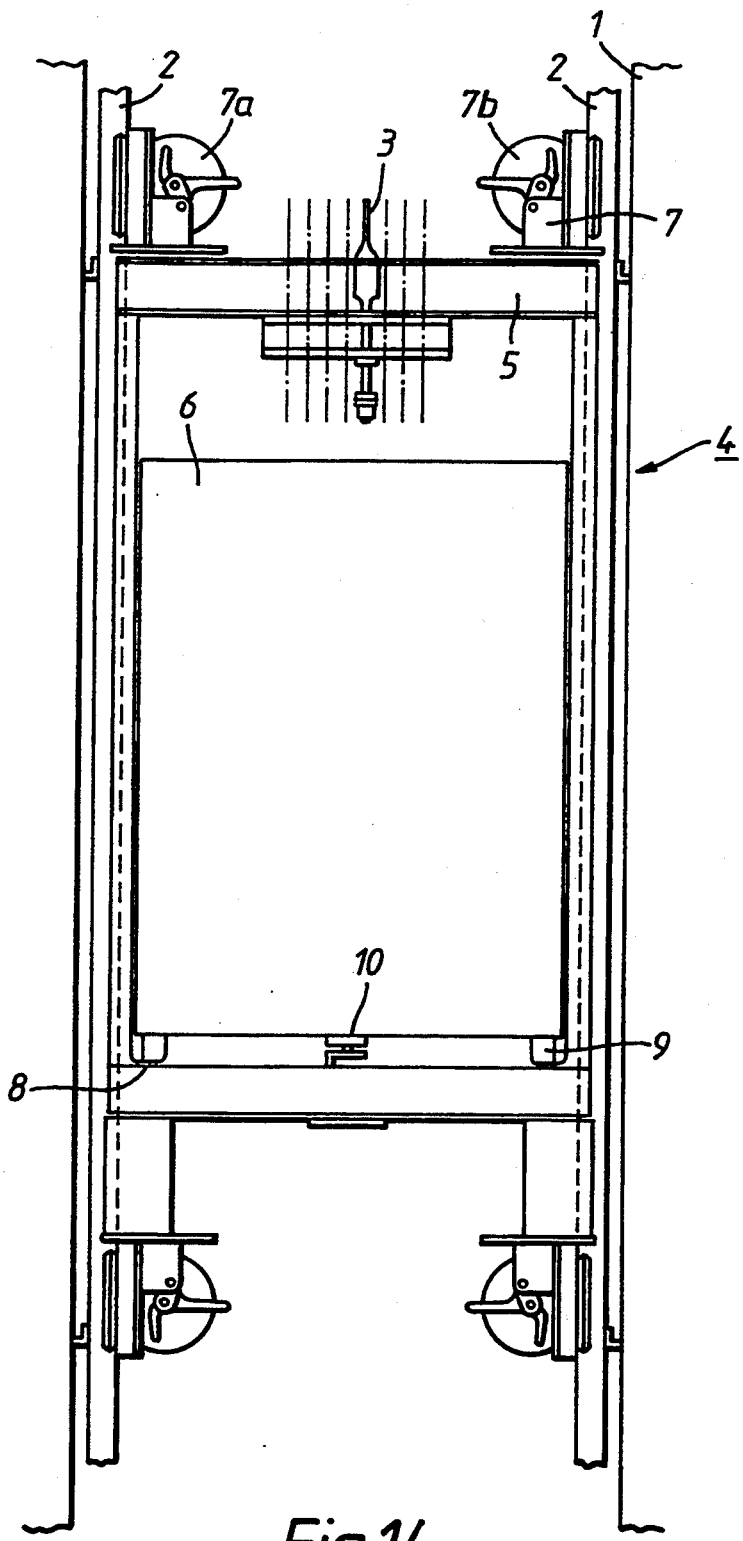
Fig.14 (PRIOR ART)
FIG. 14 is a front cross-sectional view showing a construction of a conventional elevator passenger car.
Figure 15:
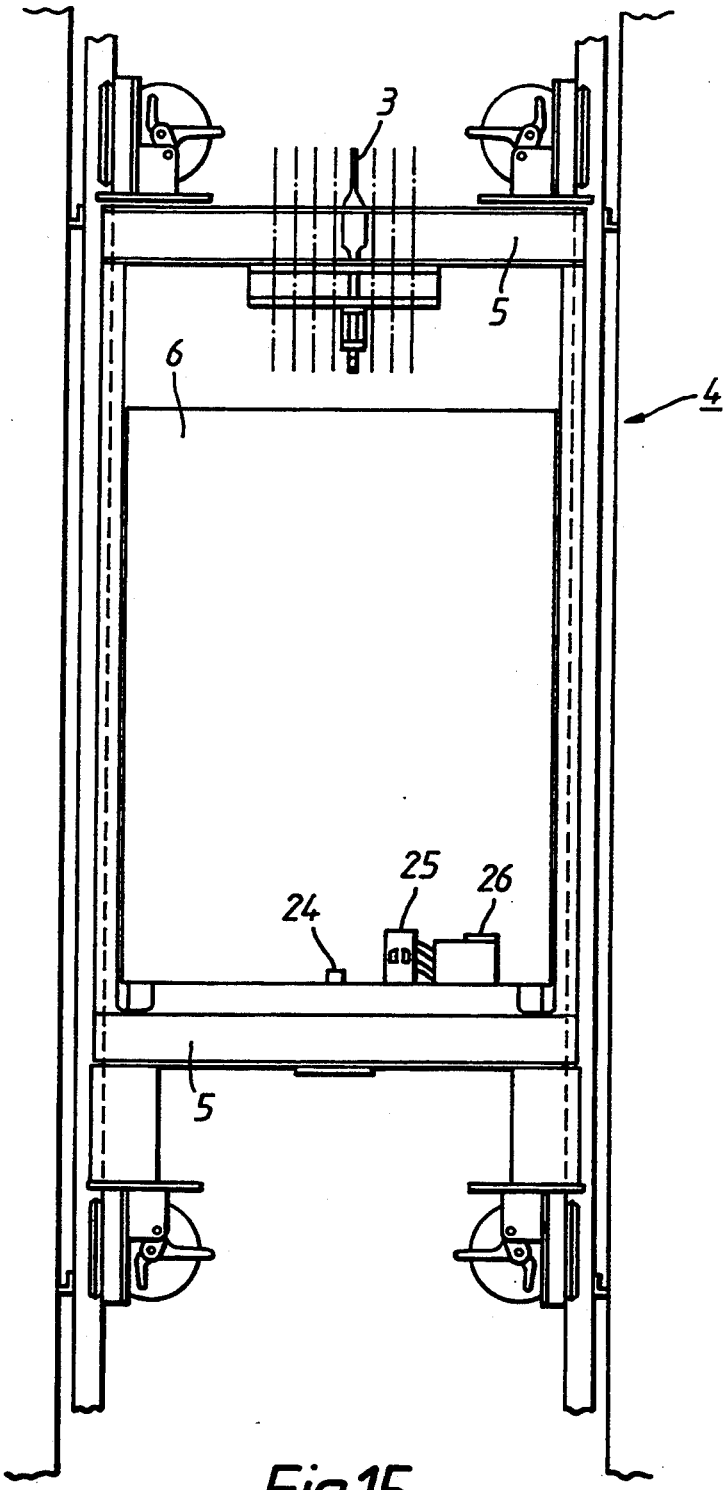
Fig.15 (PRIOR ART)
FIG. 15 is a front cross-sectional view of an elevator passenger car provided with a conventional evaluation device.

Next, the action of the embodiment constructed as above will be described with reference to FIG. 13. Actuator 12 is returned to its starting point by a signal from control device 15 when the elevator stops at a floor in response to a call from a passenger. The relationship between anti-vibration rubber element 9 and adjustment anti-vibration rubber element 13 is disengaged. After this, the door, not shown, of cage 6 is opened.

Then, the vibration acceleration is measured at the frequency to which passengers ape sensitive (i.e. the frequency at which the body resonates due to coincidence with the natural frequency of the human body) by device 27. The detected vibration acceleration is input to control device 15. Anti-vibration rubber element base 11 is then lowered by actuation of actuator 12 in response to a signal from control device 15 when the detected vibration acceleration is over a reference value at which many passengers feel uncomfortable. A codition is thereby produced in which anti-vibration rubber element 9 is directly stacked on adjustment anti-vibration rubber element 13. Thus, cage 6 is at a condition in which it is supported on floor support frame 8 through two anti-vibration rubber element systems stacked one upon another. The elevator is then moved. In this condition, the natural frequency of passenger car 4 is changed as in FIG. 8, so that the vibration acceleration is reduced at the frequency to which the passengers are sensitive. As a result, the feel of the ride in an elevator actually experienced by the passengers will be greatly improved.

As described above, with this invention, a passenger car supported on a car frame through anti-vibration rubber elements is equipped with an adjustment device such as to prevent resonance of the first order natural frequency with vibrational force applied from outside, by co-operation with the anti-vibration rubber elements. passenger car resonance can thereby be avoided even if the passenger loading changes. An elevator passenger car can thereby be provided in which the feel of the elevator ride is improved.

As described above, with this invention, the vibration experienced by a person can be measured rapidly and accurately, thereby enabling the feeling of the elevator ride to be evaluated. Thus, on site adjustment of the feel of the elevator ride can easily be performed, enabling elevators to be provided which give a comfortable elevator ride.

Obviously, numerous modifications and variations of the present invention are possible in light of the above teachings. It is therefore to be understood that within the scope of the appended claims, the invention may be practiced otherwise than as specifically described herein.

What is claimed is:

1. An elevator passenger car, comprising:
a car frame;
a cage mounted to said car frame;
an anti-vibration rubber member positioned between a bottom face of said cage and a lower portion of said car frame for supporting said cage;
a load sensing unit for measuring a passenger loading of said passenger car;
control means connected to receive said passenger loading for comparing said passenger loading with a passenger car resonance loading range to generate a control signal based on a comparison result; and
an adjustment device positioned between said bottom face of said cage and said lower portion of said car frame for receiving said control signal from said control means and for adjusting a natural frequency of said passenger car based on said control signal by co-operating with said anti-vibration rubber member;
whereby avoiding a resonance of said passenger car with an externally applied frequency force.

2. The elevator passenger car according to claim 1, wherein said control means includes:
input means for receiving said passenger loading from said load sensing unit;
comparison means connected to receive said passenger loading for comparing said passenger loading with said passenger car resonance loading range to generate a first state when said passenger loading is not included in said passenger car resonance loading range and a second state when said passenger loading is included in said passenger car resonance loading range; and
output means connected to said comparison means for generating said control signal, said control signal including said first state and said second state.

3. The elevator passenger car according to claim 2, wherein said adjustment device includes:
a base member positioned between said bottom face of said cage and said lower portion of said car frame for supporting said anti-vibration rubber member;
an actuator unit mounted on said lower portion of said car frame for supporting said base member; and
an adjustment anti-vibration rubber member mounted on said lower portion of said car frame;
said actuator unit being actuated by said control signal from said control means such that,
said actuator unit disengages the relationship between said anti-vibration rubber member and said adjustment anti-vibration rubber member thereby said cage is supported by said anti-vibration rubber member, said base member and said actuator unit when said control signal shows said first state, and
said actuator lowers said base thereby said cage is supported by said anti-vibration rubber member, said base and said adjustment anti-vibration rubber member, when said control signal shows said second state.

4. The elevator passenger car according to claim 3, wherein:
said control means includes a hydraulic power unit having a pump;
said actuator unit includes a hydraulic cylinder connected to said hydraulic power unit through a hose;

whereby said control signal being transferred from said hydraulic power unit to said hydraulic cylinder through said hose as a hydraulic power signal.

5. The elevator passenger car according to claim 2, wherein said adjustment device includes:

a base member positioned between said bottom face of said cage and said lower portion of said car frame for supporting said anti-vibration rubber member;

an actuator unit mounted on said lower portion of said car frame for supporting said base member; and an adjustment anti-vibration rubber member mounted on said lower portion of said car frame;

said actuator unit being actuated by said control signal from said control means such that, said actuator lowers said base thereby said cage is supported by said anti-vibration rubber member, said base and said adjustment anti-vibration rubber member, when said control signal shows said first state, and said actuator unit disengages the relationship between said anti-vibration rubber member and said adjustment anti-vibration rubber member thereby said cage is supported by said anti-vibration rubber member, said base member and said actuator unit when said control signal shows said second state.

6. The elevator passenger car according to claim 5, wherein:

said control means includes a hydraulic power unit having a pump;

said actuator unit includes a hydraulic cylinder connected to said hydraulic power unit through a hose;

whereby said control signal being transferred from said hydraulic power unit to said hydraulic cylinder through said hose as a hydraulic power signal.

7. A device for evaluating the feel of the ride in an elevator, comprising:

vibration means adapted to be positioned on a floor surface of a passenger car of said elevator;

said vibration means including, a frame, a pendulum having an arm and a weight element member attached to said arm, said pendulum being suspended from a ceiling of said frame, and elastic means first end of which being mounted to a side wall of said frame, said weight element member being supported by said elastic means at second end thereof in the horizontal direction, and said weight element member vibrating by means of a vibration of said passenger car; and a detector for detecting an acceleration of the vibration of said weight element member, whereby the feel of the ride in said elevator being evaluated based on said acceleration.

8. The device according to claim 7, wherein:

in said vibration means, a natural frequency of the vibrational mode of transverse swaying of said weight element member is adjusted to a natural frequency of a human body.

9. The device according to claim 7, wherein:

in said vibration means, a weight value of said weight element member is set to that of a reference body weight of a human body.

10. The device according to claim 7, wherein:

in said vibration means, a weight value of said weight element member is set to one half to one tenth of that of a reference body weight of a human body.

11. A device for evaluating the feel of the ride in an elevator, comprising:

vibration means adapted to be positioned on a floor surface of a passenger car of said elevator;

said vibration means including, a frame, a linear guide provided on said frame, a weight element member positioned on said linear guide, and elastic means, first end of which being mounted to a side wall of said frame, said weight element member being supported by said elastic means at second end thereof in the horizontal direction, and said weight element member vibrating by means of a vibration of said passenger car; and a detector for detecting an acceleration of the vibration of said weight element member, whereby the feel of the ride in said elevator being evaluated based on said acceleration.

12. The device according to claim 11, wherein:

in said vibration means, a natural frequency of the vibrational mode of transverse swaying of said weight element member is adjusted to a natural frequency of a human body.

13. An elevator passenger car, comprising:

a car frame;

a cage mounted to said car frame;

an anti-vibration rubber member positioned between a bottom face of said cage and a lower portion of said car frame for supporting said cage;

a device positioned on a floor surface of said cage for evaluating the feel of the ride in said elevator;

said device including vibration means positioned on a floor surface of said cage of said elevator and a detecor, said vibration means including, a frame, a pendulum having an arm and a weight element member attached to said arm, said pendulum being suspended from a ceiling of said frame, and elastic means first end of which being mounte to a side wall of said frame, said weight element member being supported by said elastic means at second end thereof in the horizontal direction, and said weight element member vibrating by means of a vibration of said passenger car, and said detector detecting an acceleration of the vibration of said weight element member;

control means connected to receive said acceleration for comparing a value of said acceleration with a reference value to generate a control signal based on a comparison result;

said reference value corresponding to a vibration acceleration value at which said passenger feels uncomfortable; and an adjustment device positioned between said bottom face of said cage and said lower portion of said car frame for receiving said control signal from said control means and for adjusting a natural frequency of said passenger car based on said control signal by co-operating with said anti-vibration rubber member;

whereby the feel of the ride actually experience by said passenger being improved.

14. The elevator passenger car according to claim 13, wherein said control means includes:

input means for receiving said acceleration from said device;

comparison means connected to receive said acceleration for comparing said value of said acceleration with said reference value to generate a first state when said value of said acceleration is larger than said reference value and a second state when said value of said acceleration is not larger than said reference value; and output means connected to said comparison means for generating said control signal, said control signal including said first state and said second state.

* * * * *